US011117014B1

(12) United States Patent
Scott

(10) Patent No.: US 11,117,014 B1
(45) Date of Patent: Sep. 14, 2021

(54) CONNECTION AND RESISTANCE TRAINING SYSTEM

(71) Applicant: Phillip Scott, San Diego, CA (US)

(72) Inventor: Phillip Scott, San Diego, CA (US)

( * ) Notice: Subject to any disclaimer, the term of this patent is extended or adjusted under 35 U.S.C. 154(b) by 1 day.

(21) Appl. No.: 16/533,725

(22) Filed: Aug. 6, 2019

Related U.S. Application Data

(60) Provisional application No. 62/714,862, filed on Aug. 6, 2019.

(51) Int. Cl.
*A63B 21/00* (2006.01)
*A63B 69/00* (2006.01)

(52) U.S. Cl.
CPC .... *A63B 21/4025* (2015.10); *A63B 21/00058* (2013.01); *A63B 21/4009* (2015.10); *A63B 21/4011* (2015.10); *A63B 69/0059* (2013.01); *A63B 69/0062* (2020.08)

(58) Field of Classification Search
CPC ..... A63B 21/0004; A63B 21/0043; A63B 21/00185; A63B 21/02; A63B 21/028; A63B 21/04; A63B 21/0407; A63B 21/0414; A63B 21/0428; A63B 21/0442; A63B 21/065; A63B 21/068; A63B 21/151; A63B 21/40; A63B 21/4001; A63B 21/4009; A63B 21/4011; A63B 21/4013; A63B 21/4015; A63B 21/4025; A63B 69/0057; A63B 69/0059; A63B 69/0062; A63B 23/02; A63B 23/0205; A63B 23/0222; A63B 23/0227; A63B 23/04; A63B 23/0482; A63B 23/0488; A62B 35/00; A62B 35/0006; A62B 35/0012; A62B 35/0031
See application file for complete search history.

(56) References Cited

U.S. PATENT DOCUMENTS 3,752,474 A * 8/1973 Macabet ..... A63B 23/03575 482/131
5,137,272 A * 8/1992 Wilkinson ..... A63B 21/0004 482/124
5,197,931 A * 3/1993 Wroclawsky ..... A63B 21/0552 482/121
5,362,295 A * 11/1994 Nurge ..... A63B 21/00061 482/121
6,648,844 B2 * 11/2003 Kamerman ..... A61H 1/0218 602/32
6,652,427 B2 * 11/2003 Wroclawsky ..... A63B 22/02 482/111
7,104,935 B2 * 9/2006 Matsuoka ..... A63B 21/0004 482/121

(Continued)

FOREIGN PATENT DOCUMENTS

DE 102009060117 A1 * 6/2011 ..... A63B 21/00047

*Primary Examiner* — Garrett K Atkinson
*Assistant Examiner* — Zachary T Moore
(74) *Attorney, Agent, or Firm* — Pacifica IP

(57) ABSTRACT

A wearable connection and resistance training system having a waist strap, and left and right upper leg straps and an attachment point device which serves as a connection piece configured to be held underneath a user's torso and between the user's legs to provide rotational resistance to improve and strengthen rotational abilities of a user. An alignment attachment piece and foot straps can also be attached to provide downward force/tension.

1 Claim, 2 Drawing Sheets

(56) References Cited

U.S. PATENT DOCUMENTS

| | | | | |
|---|---|---|---|---|
| 7,998,030 | B2 * | 8/2011 | Wroclawsky | A63B 21/4009 482/51 |
| 2002/0032103 | A1 * | 3/2002 | Cook | A63B 21/4009 482/23 |
| 2012/0158055 | A1 * | 6/2012 | Graham | A63B 21/4034 606/237 |
| 2015/0251038 | A1 * | 9/2015 | Bybee | A63B 21/4009 482/124 |
| 2016/0008655 | A1 * | 1/2016 | Martin | A63B 21/4019 482/124 |
| 2016/0095780 | A1 * | 4/2016 | Graham | A63B 23/0205 606/237 |
| 2017/0028244 | A1 * | 2/2017 | Schreiber | A63B 21/4043 |
| 2018/0193686 | A1 * | 7/2018 | Adeeko, Jr. | A63B 21/4025 |
| 2020/0230462 | A1 * | 7/2020 | McKeever | A61H 1/0296 |

* cited by examiner

CONNECTION AND RESISTANCE TRAINING SYSTEM

CROSS-REFERENCE TO RELATED APPLICATIONS

This application claims priority to U.S. Provisional Application No. 62/714,862, filed on Aug. 6, 2018, the disclosure of which, including any materials incorporated by reference therein, are incorporated herein by reference in their entireties.

FIELD OF THE INVENTION

The present invention relates to a wearable training system for athletes playing sports involving rotation and swinging motions, such as baseball, golf, cricket and weight training.

BACKGROUND OF THE INVENTION

Resistance bands have been used by athletes to strengthen various muscle groups. However, these bands only target specific muscle groups. Only a few training systems exist that can train rotational motion particular to sports such as baseball, golf and cricket, but none do so by providing a connection device in the manner provided by the present invention.

SUMMARY OF THE INVENTION

A connection and resistance training system and processes of using the same are provided herein. In particular, provided herein are resistance training systems and processes that force users to develop measured and consistent swinging or pitching motions while hitting or throwing a ball. In some instances, improper and/or extraneous motions by a batter or thrower can cause the system to counter the improper motion and force a correction. Further, in some instances, even with measured and proper swinging or throwing, the system can provide resistance to increase strength and power in the swing or throw. Such systems are capable of limiting the movement in the legs of a user and teaching proper alignment during a swinging, throwing motion.

The best mode to use the system is with the connection device placed directly in between the legs in the middle position. As such, the connection device or attachment point device is provided along the center of gravity to allow for rotation around its axis. An additional alignment attachment can be provided to pull the user or wearer downward (towards the ground), but in a centered manner.

The present invention can also have uses in physical rehabilitation. If one has a muscular imbalance in the body, for example, the best mode may be with the connection device or attachment point device secured closer to one side, which counteracts the imbalance by increasing the amount of resistance on one leg. If a user has a postural imbalance, the best mode may be with the connection device set up centered between the legs and connected to the alignment attachment, which aligns the waist, legs, and feet into correct or, at least, better alignment.

One advantage of the system is its ability to properly align and sequence the body through constraints. If a user begins to become misaligned, the system resists and the user will need to fight the resistance or accept of the system's resistance. Because the system's capability to connect to the feet, the user can become grounded by force provided by tension in the alignment attachment, creating a feeling to the user as if gravity has increased. This forces a movement to be powered by the strongest most balanced and capable muscles in the most efficient direction possible. If the muscles are not used to power the movement, the user loses balance. The connection device keeps the center of the body connected to the user.

Baseball swings are similar, but different than golf swings. In baseball, a pitcher throws a ball at the batter, who swings. However, sometimes the pitcher throws a pitch that tricks a hitter such that the hitter lunges forward onto the front leg or gets too far on the back leg. Both positions are weak and not ideal. When a user wears the system, faces a live pitcher, and is tricked, the instant the hitter begins to lunge, the system resists and forces the hitter to stop. If a pitcher throws the ball towards the hitter fast, the hitter has a lesser amount of time to swing. If a pitcher throws the ball towards the hitter fast, and the hitter moves towards the pitcher the hitter has even less time. The more the hitter moves towards the pitcher, and the harder the pitcher throws, the less time the hitter has to swing. If a hitter moves too far towards the pitcher, then the hitter cannot properly turn their body to finish the swing. The system forces hitters to adjust while keeping the body weight connected to the legs. It builds muscle memory in hitters by forcing physical connections between their body and the ground.

Further, some batters swing with what is called a "leg kick." A "leg kick" is the act of lifting the front leg, and then swinging. Some batters use a "toe tap." This is a similar motion to a "leg kick" only the hitter taps his foot into the ground as the swing starts. Whatever style a hitter chooses, when the hitter swings, there is a certain distance between the hitter's feet. This distance depends on each individual hitter's preference, or physical capabilities. Some choose to have a long distance in between, others a short distance. When a hitter swings, sometimes a hitter will step forward while swinging. The system allows a hitter to train all of these styles due to the connection bringing the balance to the center of the body. Because the front foot is connected to the device, when the hitter swings, it ends up pulling the back leg, which must resist in order to maintain balance.

In order for there to be resistance, there must be the impeding, slowing, or stopping effect exerted by one material thing on another. The user exerts force, and the system resists. When the user gets into a fixed position, the system exerts force, and the user must resist.

If a user isn't strong enough to resist, the system forces the user into a weak position. Once a user or forced into a weak position, that position becomes stronger. Once that position develops muscle, the user's performance improves.

The system can be used by baseball players, for example, who benefit from the rotational resistance attachment. The system can be used by golfers, for example, who benefit from the alignment attachment. The system can be used by cricket players, for example, who benefit from the wearable batting tee attachment.

One aspect of the present invention is the attachment point device that is secured between the legs, under the body's center of gravity. Additional attachments, such as a tee system (for batters) and other attachments can be provided to attach to the attachment point device.

The alignment attachment, the wearable batting tee attachment, and the rotational resistance attachment are capable of being connected to the attachment point device or connection piece. These attachments can extend in various directions to attach to limbs and other body sections of a user.

The rotational resistance attachment can be attached from the back hip, wrapped across the front of the body, and around the user's backside to the attachment point device or connection piece. It can be attached from the front hip directly along the backside to the attachment point or connection piece. By externally connecting to the center of gravity connection device, the hips actively rotate one way and resist rotation the other way.

The alignment attachment can have two elastic bands that connect down to the feet and provide a balanced vertical resistance directly under the connection piece, which is centered under the user. The waist can have two elastic bands connected to the vertical lining bands, which balance the pull from the bands connected to the feet. There is an adjustable amount of resistance from the waist and the feet, within the vertical bands in the alignment attachment.

The connection piece can be a simple attachment point such as a ring or a set of elastic bands, that can allows for multiple attachments to be attached thereto. The attachment point device may be rigid or elastic—to allow for expansion of the device for use in sports that may require more movement such as running or sports involving jumping.

The present invention can be used with a wearable batting tee system as disclosed in U.S. Pat. No. 10,315,091, which disclosure is incorporated by reference as if fully recited herein.

DETAILED DESCRIPTION OF THE DRAWINGS

Figure 1:
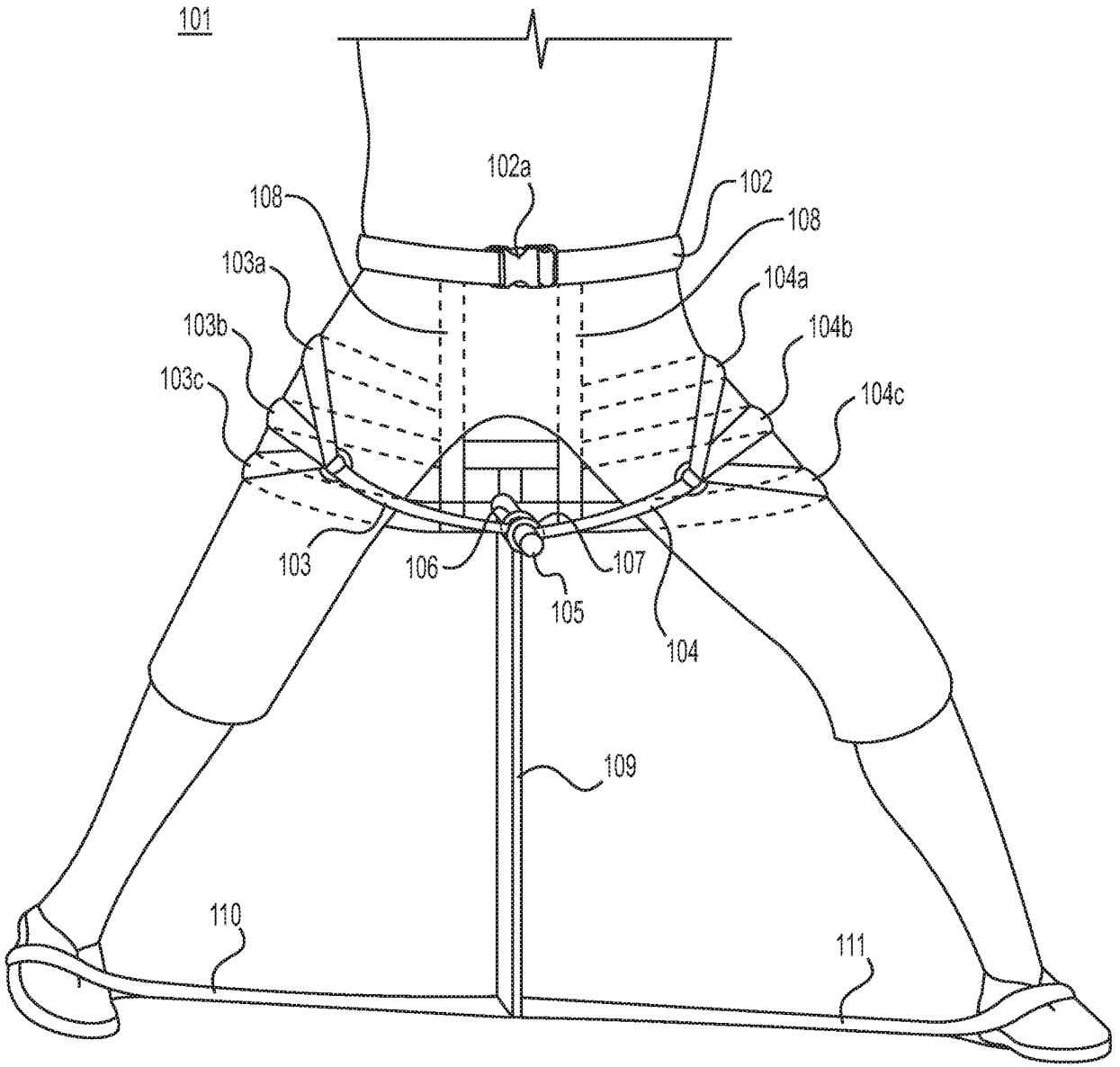
FIG. 1 is a diagram of a user using an exemplary embodiment of the connection and resistance training system in accordance with the present invention.

Turning now to FIG. 1, a connection and resistance training system 101 is shown. System 101 has waist strap 102, elastic right upper leg strap 103, elastic left upper leg strap 104 and connection piece 105. Right and left upper leg straps 103 and 104 are connected to attachment point 105 by a fastener such as a ring 106 and 107 or other types of fasteners such as a carabiner, for example.

Right upper leg strap 103 can further comprise additional straps 103*a-c*. Similarly, left upper leg strap 104 can further comprise additional straps 104*a-c*.

Waist strap 102 can have a buckle or clip 102*a* to allow a user to secure and tighten the waist strap. Waist strap 102 is connected to leg straps 103 and 104 by at least one rear vertical strap 108.

In one exemplary embodiment, alignment attachment strap 109 extends downwardly from attachment point 105 and right and left foot straps 110 and 111 extend perpendicularly from alignment attachment strap 109 when in use.

Figure 2:
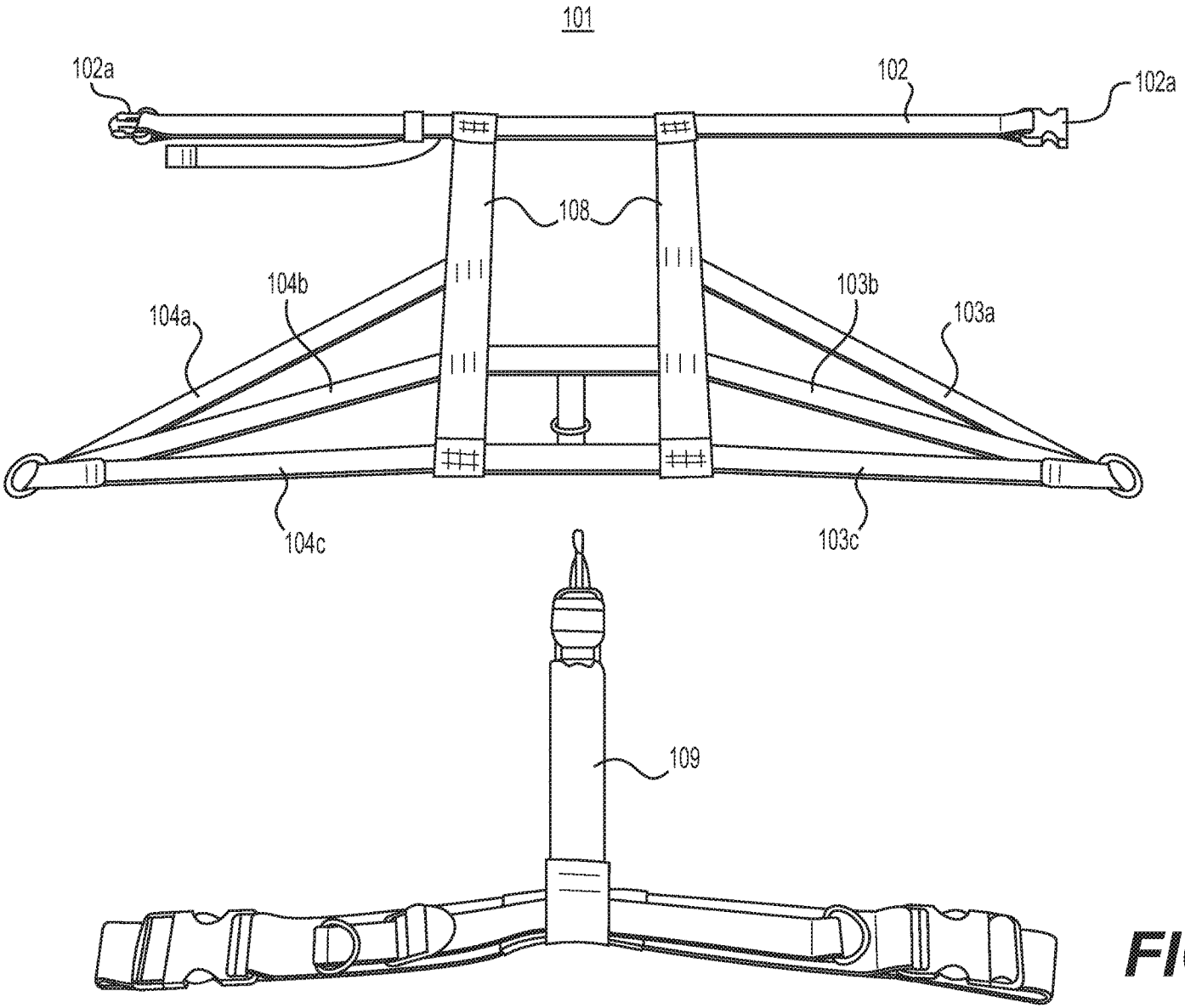
FIG. 2 is another exemplary embodiment of the connection and resistance training system.

FIG. 2 shows another exemplary embodiment of a connection and resistance system 101. As can be seen, vertical straps 108 extend perpendicularly from waist strap 102. Right and left upper leg straps 103*a-c* and 104*a-c* are connected to vertical straps 108. Alignment attachment 109 is also shown in this embodiment with a clip formed at an end thereof.

In another exemplary embodiment, sensors (not visible) can be provided throughout the system to relay information about alignment and resistance to a user via an electronic device such as a phone.

The invention claimed is:

1. A wearable resistance training system comprising:

a waist strap configured to be worn around a wearer's torso;

at least one vertical strap extending downwardly from said waist strap;

an attachment point device connected to said waist strap by said at least one vertical strap;

an elastic right upper leg strap extending laterally from said attachment point device;

an elastic left upper leg strap extending laterally from said attachment point device;

an alignment attachment extending downwardly from said attachment point device and parallel to said at least one vertical strap; and left and right foot straps extending perpendicularly from said alignment attachment when worn by the wearer;

wherein said attachment point is configured to be positioned halfway between the wearer's legs and directly beneath the wearer's torso; and wherein said wearable resistance training system provides rotational resistance around an axis and alignment correction to the wearer.

* * * * *